United States Patent [19]

Seragnoli

[11] 4,221,287

[45] Sep. 9, 1980

[54] DEVICE FOR FORMING AND TRANSFERRING BATCHES OF PRODUCTS IN AUTOMATIC WRAPPING MACHINES

[75] Inventor: Enzo Seragnoli, Bologna, Italy

[73] Assignee: G.D. Societa per Azioni, Bologna, Italy

[21] Appl. No.: 26,679

[22] Filed: Apr. 3, 1979

[30] Foreign Application Priority Data

Apr. 27, 1978 [IT] Italy ..... 3405 A/78

[51] Int. Cl.[3] ..... B65G 29/00; B65G 65/00

[52] U.S. Cl. ..... 198/418; 53/171; 53/225; 198/425; 198/426

[58] Field of Search ..... 198/425, 426, 418; 53/171, 225, 234, 531

[56] References Cited

U.S. PATENT DOCUMENTS

| | | | |
|---|---|---|---|
| 1,883,606 | 10/1932 | DeBack et al. | 198/425 |
| 2,613,021 | 10/1952 | Bowes | 53/538 |
| 2,982,065 | 5/1961 | Giles et al. | 53/531 |
| 3,435,584 | 4/1969 | Prechter | 53/542 X |

FOREIGN PATENT DOCUMENTS 703098 4/1966 Italy .

*Primary Examiner*—John Sipos

*Attorney, Agent, or Firm*—Browdy and Neimark

[57] ABSTRACT

Disclosed herein is a device constituted by a rotatable head provided with radial compartments which hold batches of products and comprising a pusher for inserting the individual products into a compartment, and a device for supplying the individual products to the pusher. A movable wall is provided inside each compartment and this is sustained by a corresponding shaft whose rear extremity terminates in a rack. The racks mesh in succession with the counter-rotating gears of two drive devices movable in synchronization with the said pusher in such a way that the wall of the compartment that is in the product infeed position is intermittently displaced from the front of the said compartment to the back thereof, while the wall of the compartment adjacent to but preceding the previously mentioned compartment is intermittently displaced from the back towards the front thereof.

7 Claims, 5 Drawing Figures

DEVICE FOR FORMING AND TRANSFERRING BATCHES OF PRODUCTS IN AUTOMATIC WRAPPING MACHINES

BACKGROUND OF THE INVENTION

This invention has as its subject a device for forming and transforming batches of products in automatic wrapping machines. To be more precise, the said device, for which particularly interesting applications exist in the confectionary and the pharmaceutical field, places side by side and aligns previously wrapped products supplied thereto in succession.

The batches of products thus formed are then sent to units provided to overwrap them.

The final result of the said operations is the provision of the type of wrap commonly known in Italy as a "stick".

The device is question is, therefore, destined to be inserted and to constitute a link-up between a machine for wrapping the individual products and a machine for wrapping the batches of products or, in other words, between machines presently able to run at very high output speeds.

DESCRIPTION OF THE PRIOR ART

A machine for wrapping pieces of candy individually at the rate of over one thousand pieces per minute, also made by G.D. S.p.A., is known in commerce.

The devices of the type in question according to the prior art have not, however, shown themselves able to offer, at the said running speeds, a full guarantee of operating satisfactorily, with the result of affecting negatively the efficiency of the complete wrapping line.

Devices of a known type envisage the use of a cylindrical wheel or head, rotatable intermittently around its own axis, and provided all around the permiter thereof with open radial compartments of substantially parallelepiped shape to enable the products to be inserted therein by a pusher. The products, pushing one against the other each time a new product is inserted, slide radially between the longitudinal walls of the compartment until the said compartment has been completely filled, that is to say, until a batch has been formed. Rotating intermittently, the said head carries the batches of products up to a station for transfer to the overwrapping machine.

Particular care needs to be taken in the performance of the aforementioned operations in order to prevent the products from adopting incorrect conformations both at the compartment insertion stage and while the batch is being completed.

This problem can arise after each forward movement of the pusher because of the products knocking against the longitudinal walls or the back of the compartment, or against one another.

Trouble of this nature causes damage to the products and to the wraps thereon, and gives rise to the need to eliminate the damaged products.

On account of the foregoing, use is rendered advisable, in known devices of the aforementioned type, of means that are able to exercise a constant checking and restraining action on the products.

In the above described art, wherein use is made of the said cylindrical wheel or head with compartments therein, steps are taken to solve the said problems in various ways.

A device is, in fact, known in which at least one of the longitudinal walls of the compartments is connected, through elastic members, to its support members, and is so arranged as to exert a continuous pressing action on the products right from the moment of their insertion in a given compartment.

When the said elastic members are suitably adjusted, although the corresponding longitudinal wall of a given compartment allows the products to slide during the formation of the batch, it accentuates their stability and by acting as a brake, limits the harmful effects of impacts.

In other devices of a known type, the back walls of the compartments are mounted in a sliding fashion with respect to the longitudinal walls.

During the formation of the batch, the said wall is displaced with an inching portion from the mouth to the back extremity of the compartment under the thrust of products inserted one by one by the pusher.

The said progressive enlargement of the compartment or, in other words, the constant support given to the batch under formation by the movable back wall, has the purpose of preventing the products from capsizing or from adopting an incorrect conformation.

The forces of inertia, under whose action the back wall tends to effect excessive sliding movements at the time each product is inserted in the compartment, are contrasted by braking devices that act on each of the said walls.

In both of the cases described, the satisfactory operation of the said devices of known type is dependent on accurate setting operations.

In the first case, in fact, excessive pressure of the longitudinal wall or walls of the compartments can cause damage to the products and to the wrappings thereon at the time the batch is being formed and during the subsequent transfer.

On the other hand, inadequate pressure of the said walls may allow an incorrect conformation of the products and them to even be capsized.

As regards the second case mentioned above, an inexact setting of the braking devices that act on the back walls may bring about, if it is excessive, the crushing of the products and of their wrappings between the pusher and the said back wall.

On the contrary, braking action that is too weak may be the cause of the back wall sliding excessively at the time the products are inserted in the compartment and thus of the said products being in an incorrect conformation or even capsized.

It is obvious that the said problems gradually worsen as the speed increases until they constitute the principal reason for the operational limits of the said devices of a known type.

Finally, it would be noted that the devices of a known type show themselves preferably able to handle products of parallelepiped shape.

When forming batches of products of a different shape, such as circular section pastilles, the stability possibilities of which are in themselves less, the aforementioned problems can be seen to become more pronounced.

SUMMARY OF THE INVENTION

The object of the present invention is to make available a device of the type described above that is able to operate at the very high running speeds of the present wrapping machines.

A further object of the present invention is to make available a device of the aforementioned type that is able to handle the products with the utmost delicacy, yet exert on them while the batch is undergoing formation, a constant checking and restraining action.

Another object still of the present invention is to make available a device of the aformentioned type that is able to handle products of any shape or section.

These and other objects too have all been attained through the device for forming and transferring batches of products in automatic wrapping machines, comprising an intermittently rotatable head provided with radial, equidistant, compartments for holding batches of products, a pusher located, with respect to the said rotatable head, in the region of a product infeed position at which the said compartments pause in succession, the said pusher being movable in the direction of the said compartments with a to-and-fro motion longitudinally thereto, a device for supplying the products to the said pusher, located in the region of the said infeed position, at least one movable wall placed inside each of the said compartments in such a way as to receive flush there against, the first of the products inserted therein, and secured to a corresponding support member that slides longitudinally to the compartment concerned in order to guide the said wall from the front extremity towards the back of the compartment and then back to the initial position, and a device for taking possession of a formed batch of products, placed, with respect to the rotatable head, in the region of an exiting position forthe formed batches of products, located downstream of the said infeed position in the direction of rotation of the said rotatable head, essential features of the device being that the said radial compartments are arranged longitudinally parallel to the axis of the said rotatable head and that it comprises a stationary chamber in which the products supplied by the said infeed device are held immobile, placed along the path followed by the said pusher and in the proximity of the front extremity of the said compartments; a lamina that lies on a plane substantially perpendicular to the axis of the rotatable head between the said stationary chamber and the said front extremity, and is movable alternately over the said plane between a first portion in which the front extremity of the compartment in the rotatable head at a halt in the product infeed position is closed and a second position in which the said front extremity is left open; and a pair of drive devices given intermittent motion in an opposite movement direction to each other, that operate in synchronization with the forward movement of the pusher and are so arranged as to carry in intermittent motion in successive steps, during each pause of the said rotatable head, the wall support member placed inside the compartment located in the region of the said infeed position, so as to displace the wall concerned from the front extremity to the back extremity of the said compartment, and the wall support member placed inside a compartment upstream of the previously mentioned compartment, so as to displace the wall concerned from the back extremity to the front extremity of the said compartment, respectively.

BRIEF DESCRIPTION OF THE DRAWINGS

Further characteristics and advantages of the device according to the invention will emerge more clearly from the following detailed description of a preferred form of embodiment, illustrated purely as an unlimited example on the accompanying drawings, in which.

DESCRIPTION OF THE PREFERRED EMBODIMENT

Figures 1, 4:
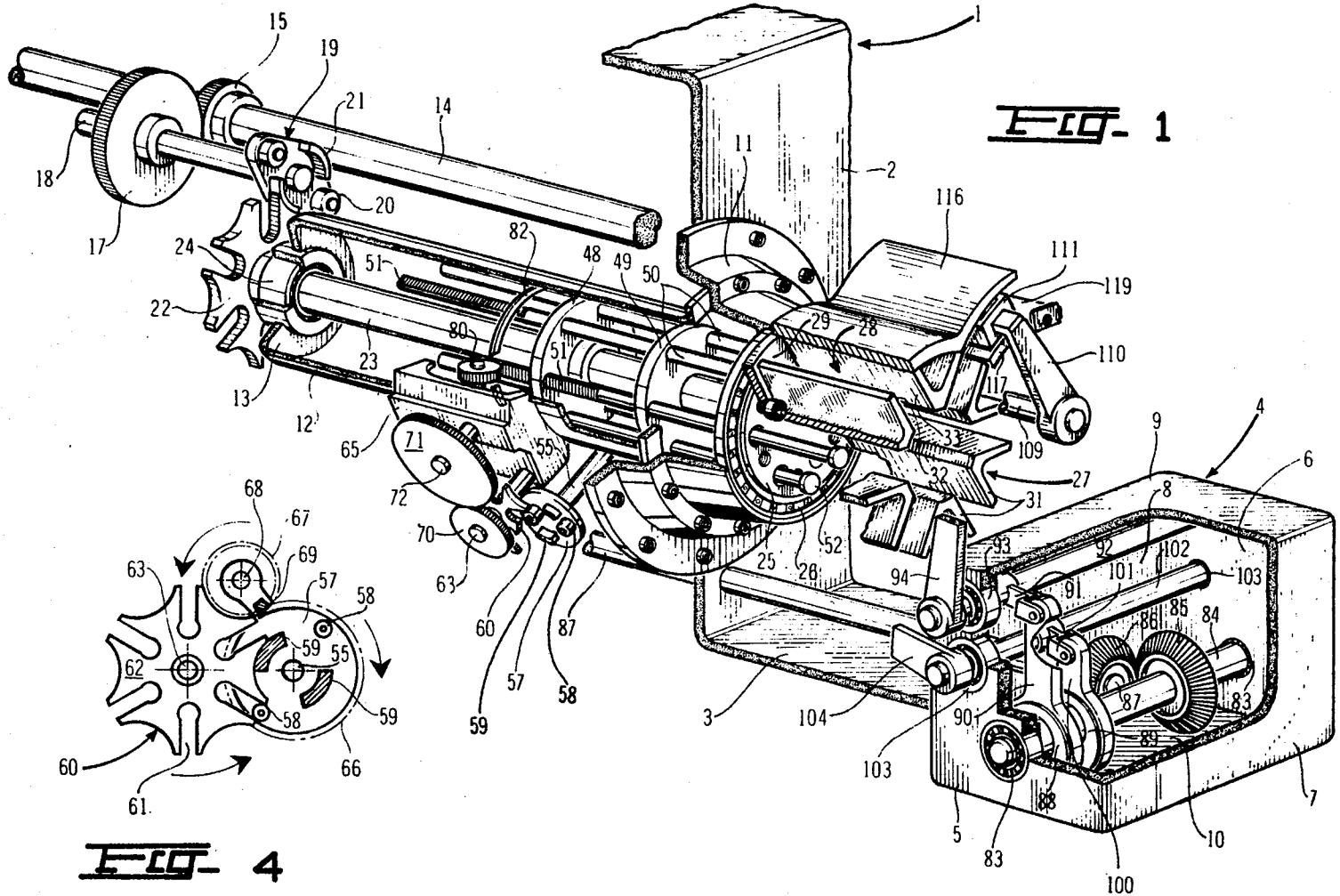
FIG. 1 shows the device according to the invention, in a perspective view with certain parts in sectional form or removed in order that others may become visible.
FIG. 4 shows, out of scale, certain parts of the mechanism of the device according to the invention.

With particular reference to FIG. 1, shown globally at 1 there is a casing that supports the device according to the invention and holds the operating means thereof.

At 2 there is the wall or right hand side of the said casing 1, and at 3 a horizontal plate integral with the lower extremity of the wall 2.

In the region of its right hand extremity, the horizontal plate 3 supports a substantially parallelepiped box shaped body 4 in which part of the mechanical devices for the device in question are housed.

The box shaped body 4 is deliminated laterally by the walls 5 and 6 perpendicular to the vertical wall 2, and by the walls 7 and 8 parallel to the vertical wall 2, the top and bottom thereof being deliminated by the walls 9 and 10.

In the vertical wall 2 there is a circular opening, in the region of which, externally to the casing 1, a substantially cylindrical flange 11 is fixed, the axis of this being perpendicular to the said wall 2.

Inside the casing 1, the flange 11 supports a hollow cylindrical body 12 coaxial thereto and deliminated on the left hand side, with respect to FIG. 1, by a bottom wall 13.

The mechanism of the device in question terminates at a shaft 14 inside the casing 1, perpendicular to the wall 2, rotatable clockwise and connected to a source of drive that is not illustrated.

Figure 3:
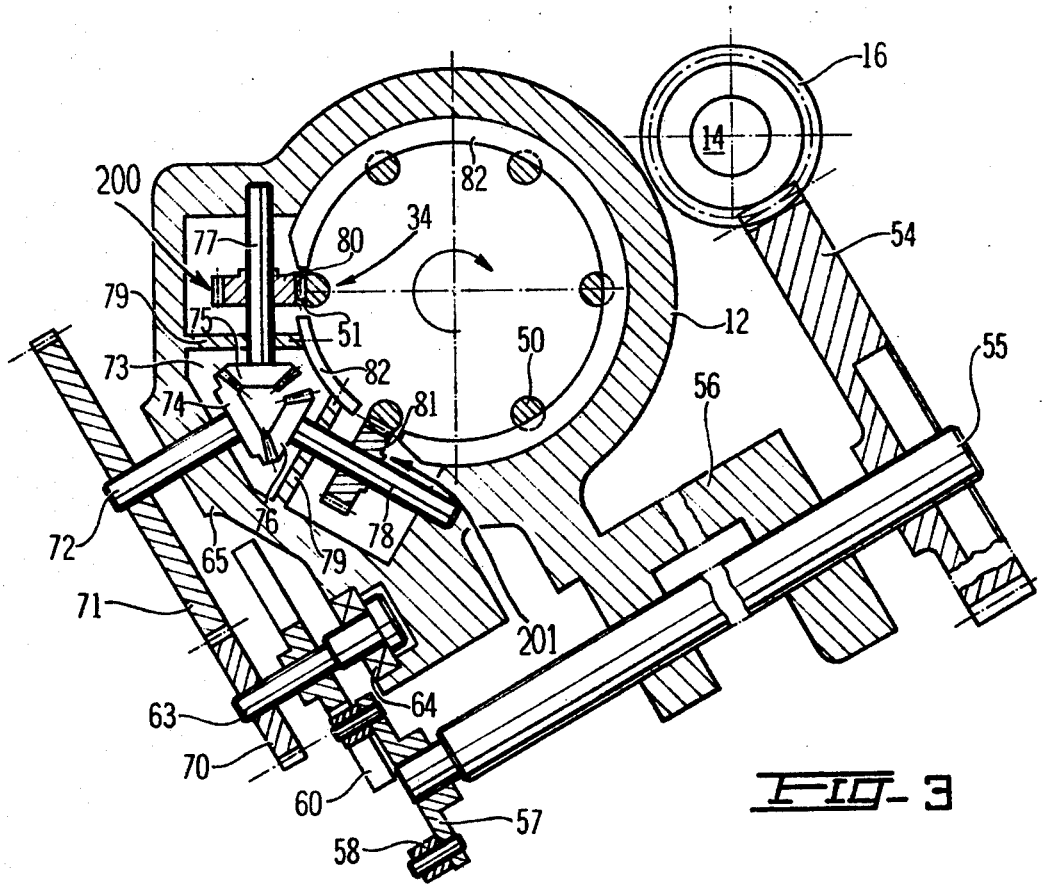
FIG. 3 shows certain parts of the mechanism of the device according to the invention, in a larger scale than in FIGS. 1 and 2 and in a sectional view.

Close to the left hand extremity of the shaft 14, again with reference to FIG. 1, a gearwheel 15 is fixedly mounted, while to the right hand extremity of the said shaft is fixed a gearwheel 16 with helical teeth (see FIG. 3).

The gearwheel 15 meshes with a gearwheel 17 keyed to the left hand extremity of a shaft 18 parallel to the shaft 14.

To the other extremity of the shaft 18 is fixed a device of a known type 19, provided with two idle rollers 20 and two arcuate sectors or centering devices 21 designed to intermittently operate a Geneva wheel 22 having six compartments. The said Geneva wheel 22 is fixedly mounted, in the proximity of the bottom wall 13, on the left hand extremity of a shaft 23 coaxial to the cylindrical body 12.

The said shaft 23, supported in the region of the said extremity by the bottom wall 13 with the interposition of a bearing 24, passes through the entire cylindrical body 12 and the flange 11.

The other extremity of the shaft 23 is integral with a disk 25 coaxial thereto, placed at the mouth of the flange 11 and supported by this through a bearing 26.

Cantilever mounted on the said disk 25 there is a wheel or head 27 rotatable, through the mechanism described above, intermittently in a clockwise direction around its own axis, with rotations through 60° per intermittent displacement, and having along its perimeter six radial compartments 28 designed to hold parallelepiped shaped objects of a certain length parallel to the shaft 23.

More precisely, the said head 27 is constituted by a circular plate 29 fixed directly, through screws, to the disk 25, and by six bars 31 fixed in a projecting way to the said plate 29, equidistant along the perimeter and parallel to the said axis of rotation.

The bars 31 are of a cross section in the form of a V, with the vertex turned towards the axis of rotation of the head 27 in such a way as to have two rectangular external longitudinal walls 32 and 33, respectively, in the upstream to downstream direction of rotation of the head 27.

The aforementioned compartments 28 are deliminated at one extremity by the previously mentioned plate 29, and laterally by the two walls 32 and 33, parallel to one another and belonging to two adjacent bars 31.

With respect to the axis of rotation, the head 27 is set angularly so that, after each advancement thereof, two diagrammatically opposed compartments 28 have their lateral walls 32 and 33 arranged parallel to the horizontal plane that passes along the said axis.

Of the two compartments 28, the one on the left, looking at FIG. 2, occupies a position 34 defined, for reasons that will will be seen more clearly hereinafter, the infeed position.

Two carinated guides 35 and 36, coaxial to the head 27 follow a section of the perimeter of this, one outside and one inside, respectively, commencing at an area close to the said horizontal plane and extending clockwise over an arc of substantially 120° up to a position hereinafter defined the exit position.

The carinated guide 36 is provided with a tail piece 38 that extends in the direction of the axis of the head 27, past the free extremity of the bars 31.

A parallelepiped bar 40, horizontal and directed towards the outside of the head 27 perpendicularly to the axis thereof is integral with the tail piece 38.

The upper side 41 of the bar 40 lies on the same plane as the wall 33 of the compartment 28 at a halt in the region of the infeed position 34, and is delimitated at the side opposite to the head 27 by a raised edge 42.

The carinated guide 35 is provided with a tail piece 43 that extends in the direction of the axis of the head 27, past the free extremity of the bars 31.

The said tail piece has a lower side 44 parallel to the side 41 and on the same plane as the wall 32 of the compartment 28 at a halt in the said infeed position 34.

The side 44 is delimitated by an edge 45 that stretches downwards in vertical alignment with the said edge 42.

Figure 2:
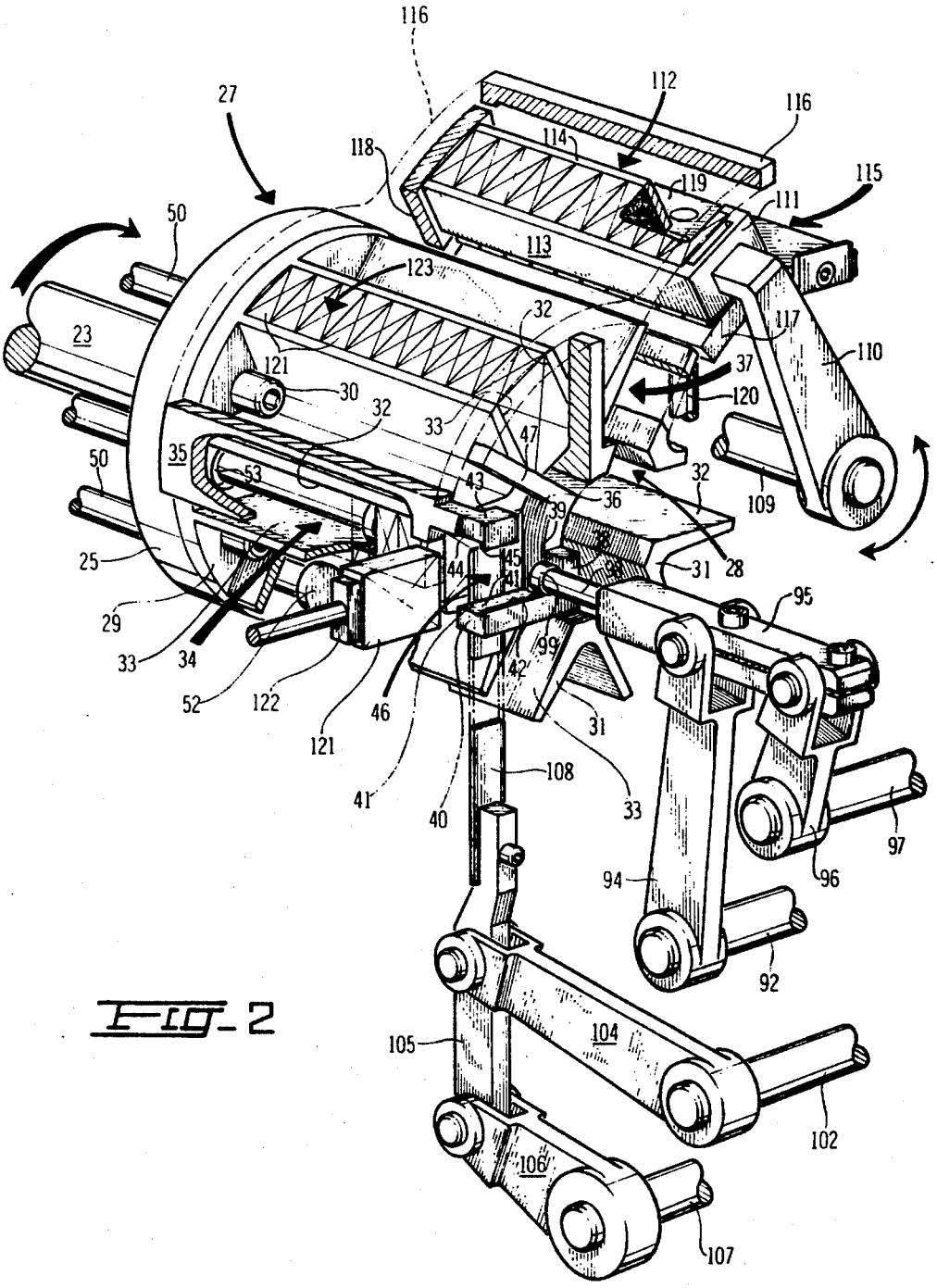
FIG. 2 shows part of the device according to the invention, in a perspective view and in a larger scale than in FIG. 1, with certain parts in sectional form or removed in order that others may become visible.

The sides 41 and 44, together with their respective edges 42 and 45 and the vertical wall 39, jointly define a substantially parallelepiped chamber shown at 46 in FIG. 2.

The carinated guide 36 is integral with a guide plate 47 in the shape of a part of a circular ring concentric to the head 27 and firmly attached to the right hand extremity thereof (see FIG. 2).

The initial extremity of the said guide plate 47 is, in the direction of rotation of the head 27, placed immediately downstream of the tail piece 43 and it extends until it is close to the final extremity of the carinated guides 35 and 36.

In the inside of the cylindrical body 12 there are, going from left to right (see FIG. 1), two disks 48 and 49 keyed onto the shaft 23 and coaxial thereto.

Six small shafts or counter-pushers 50, parallel to the shaft 23 and in alignment with each of the said compartments 28 in the head 27, pass through the two disks 48 and 49 and are slidingly supported by them.

One extremity of the said counter-pushers 50 is provided with a rack 51 to the left of the disk 48, while the other that passes through holes drilled in the disk 25 and in the circular plate 29 and goes inside the compartments 28, is provided with the disks or walls 52.

Under the action of mechanical devices described hereinafter, the said counter-pushers 50 are able to intermittently slide axially in the two directions between two extreme positions, one of which is defined the disengagement position, and the other the position of full insertion with respect to the compartments 28 to which the said counter-pushers are connected.

When in the said disengagement position, the disks 52 are contained in the housings 53 made in the plate 29, while in the said position of full insertion, they are placed at the outside proximity, or entrance, to the compartments 28.

The previously mentioned mechanism for operating the counter-pushers 40 shown globally at 200 and 201 in FIG. 3, terminates at a helical gearwheel 16 (see FIG. 3), rotating counter clockwise, which, through a second helical gearwheel 54, carries in rotation a shaft 55 perpendicular to the shaft 14, supported by a tail piece 56 fixed to the lower part of the cylindrical body 12.

The left hand extremity of the shaft 55 (see FIGS. 1, 3 and 4) is integral with a device 57 of a known type that comprises, in diametrically opposed positions, two idle rollers 58 and interposed there between, two arcuate sectors or centering devices 59.

The device 57 is provided to operate a Geneva wheel 60 with six compartments 61, the arms of which are shown at 62 in FIG. 4. The said Geneva wheel 60 is keyed to a journal 63 parallel to the shaft 55 and supported, with the interposition of a bearing 64, by a block 65 integral with the cylindrical body 12 (see FIGS. 1 and 3).

A gear 66 (shown only in FIG. 4 by a line in dots and dashes) keyed onto the said shaft 55 carries in rotation, through a gear 67, a shaft 68 parallel to the shaft 55 and supported in a way that cannot be seen, by the said block 65.

One extremity of the shaft 68 is integral with a device for instantaneously locking the Geneva wheel 60 constituted by an auxiliary arcuate sector or third centering device 69 which, in the same way as the centering devices 59, can mate with the concave extremities of the arms 62.

In accordance with known practices, the said third centering device 69 meshes with one of the arms 62 at the time one of the rollers 58 exits from a compartment 61, that is to say, after each advancement or step of the Geneva wheel 60.

The latter and the assemblies connected thereto are, in this way, locked instantaneously even at very high speeds.

The journal 63 (see FIGS. 1 and 3) has keyed to it a gear 70 that meshes with a gear 71 integral with the left hand extremity of a shaft 72 supported by the block 65 parallel to the shaft 55.

The other extremity of the shaft 72, stretching inside a cavity 73 machined inside the block 65, is fixed to a bevel gear 74.

The shaft 72 positioned, looking at FIG. 1, on the left of the disk 48, has a radial behaviour compared to the cylindrical body 12 and, on the basis of what can be seen in the sectional view in FIG. 3, is placed symmetrically between the counter-pusher 50 applicable to the compartment 28, occupying the infeed position 34, and the counter-pusher 50 immediately prior thereto in the upstream to downstream direction of rotation of the head 27.

The aforementioned bevel gear 74 carries in intermittent rotation inside the cavity 73, two identical mechanisms placed symmetrically with respect to the radial plane of the cylindrical body 12 passing through the axis of the shaft 72.

The said mechanisms comprise the bevel gears 75 and 76 that mesh with the said gear 74 and the shafts 77 and 78 integral with the gear 75 and the gear 76, respectively, and are supported rotatably by the block 65 and by the tail pieces 79 thereof.

The two shafts 77 and 78, inclined at 120° one respect to the other, have keyed on them two gears 80 and 81, respectively, which are destined to rotate intermittently, the former (visible in FIG. 1) counter clockwise, and the latter (not visible in the said figure) clockwise.

The said gears 80 and 81 are destined, via a corresponding opening in the cylindrical body 12, to mesh with the rack 51 of the counter-pusher 50 connected to the compartment 28 at a halt in the infeed position 34 and the rack 51 of the counter-pusher 50 connected to the compartment 28 adjacent and upstream thereto, respectively.

As a consequence of the foregoing, the two extremities provided with a disk 52 of the said counter pushers 50 move, inching fashion and in opposite directions, through the compartments 28 concerned from one direction to another, and more precisely, the counter pusher 50, moved by the gear 80, slides from right to left looking at FIGS. 1 and 2 from the said position of full insertion to the said disengagement position, while the counter pusher 50, moved by the gear 81, slides from left to right or, in other words, from the said disengagement position to the position of full insertion.

Inside the said body 12 and closely attached thereto, substantially on the same vertical plane on which the axes of the two shafts 77 and 78 lie, there is a circular ring guide 82 designed to engage with the racks 51 of the counter-pushers 50 during the rotation of the head 27 (see FIGS. 1 and 3).

The said guide has two breaks in it in the region of the two gears 80 and 81 and in the area in between these, it is supported by the said tail pieces 79 of the block 65.

The box shaped body 4 to which prior reference was made earlier on, supports internally, through the walls 5 and 6 and with the interposition of the bearings 83, a shaft 84 horizontal and parallel to the walls 7 and 8 (see FIG. 1). On the said shaft 84 is fixedly mounted a bevel gear 85 that mates with a second bevel gear 86 keyed to the right hand extremity of a shaft 87 which is horizontal and perpendicular to the shaft 84, the former being supported by the wall 8 of the box shaped body 4 and by the wall 2 of the casing 1.

The other extremity of the shaft 87 inside the casing 1 is connected, through means that are not shown, to the same source of drive as the shaft 14.

The shaft 84 has two cams 88 and 89 fixedly mounted on it. Fitted to the cam 88 in a way allowing it to rotate, there is a connecting rod 90 that stretches upwards, the upper extremity of this being pivoted to one extremity of a lever 91 integral with a shaft 92 parallel to the shaft 84 and supported by the walls 5 and 6 with the interposition of the bearings 93.

The front extremity of the shaft 92 that projects out of the box shaped body 4 is fixed (see also FIG. 2) to a lever 94 that extends upwards, the upper extremity of which, fashioned like a fork, is pivoted midway along a rod 95 that extends parallel to the axis of the cylindrical body 12.

The right hand extremity of the rod 95, looking at FIG. 2, is pivoted to the fork shaped extremity of a second lever 96 secured pivotally to a journal 97 parallel to the shaft 92 and supported cantilever fashion, in a way that is not illustrated, by the wall 5.

The left hand extremity of the rod 95 is fixedly in alignment with a shaft or pusher 98 whose extremity is provided with a disk 99. The said shaft 98 is placed, with respect to the rotatable head 27, at a level in between the bar 40 and the tail piece 43 and is lined up with the counter-pusher 50 of the compartment 28 located in the infeed position 34.

The above described mechanisms give the shaft 98 a horizontal forward and backward movement with respect to the rotatable head 27, between an external position and a position inside the chamber 46.

A connecting rod 100 is mounted rotatably on the second cam 89 and extending upwards, it is connected at the top, through a lever 101, to a shaft 102 parallel to the shaft 84 and supported by the walls 5 and 6 with the interposition of bearings 103.

The front extremity of the shaft 102, outside the box shaped body 4, is pivotally connected in a rigid fashion to a lever 104 that is substantially horizontal, the free extremity of which, fashioned in the form of a fork, is pivoted to a virtually vertical rod 105 at an intermediate point.

The lower extremity of the rod 105 is pivoted to the fork shaped extremity of a second substantially horizontal lever 106, pivotally mounted on a journal 107 parallel to the shaft 102 and supported cantilever fashion, in a way that is not illustrated, by the wall 5 of the box shaped body 4.

A vertical lamina 108 placed on edge with respect to the axis of the cylindrical body 12 is fixed to the upper extremity of the rod 105.

The above described mechanisms give the lamina 108 a forward and backward movement along the plane on which it lies. The said lamina 108 is positioned, with respect to the rotatable head 27, so as to be able to slide in the space in between the bar 40 and the compartment 28 that occupies the infeed position 34.

At 109 there is a shaft parallel to the shaft 14 and supported, close to the head 27, by the wall 2. The said shaft 109, through devices not shown on the drawings, can oscillate around its own axis and the right hand extremity thereof is provided with an arm 110, perpendicular thereto, that extends past the free extremity of the bars 31.

The free extremity of the said arm 110, bent at a right angle towards the wall 2, is integral with a rectangular plate 111 that constitutes the bottom of a U shaped device for taking possession of the batched products, shown globally at 112, the arms of which are constituted by the laminae 113 and 114 directed towards the wall 2, parallel to the shaft 109 and arranged perpendicularly to the path followed by them as the shaft 109 rotates.

The longitudinal and the transverse dimensions of the said laminae 113 and 114 are slightly less than the length and width, respectively, of the compartments 28, while the space in between them is a little greater than the radial dimension of the said compartments with respect to the head 27.

The said U shaped device 112 moves along a path that has as its limits on one side, the inside of the compartment 28 in the exit position 37, and on the other, a position 115, outside the head 27, hereinafter defined the transfer position.

A carinated guide 116 placed in continuation of the guide 35 and a carinated guide 117, supported in a way not shown on the drawings, both coaxial to the shaft 109, are located between the said exit position 37 and the said transfer position 115, their task being, as will be seen below, that of acting as guide members for the batches of products exiting from the head 27.

A plate 118 whose conformation is that of a part of a circular ring, integral with the upper carinated guide 116 and lying on the same plane as the circular plate 29, extends between the said exit position 37 and the said transfer position 115.

In the region of the transfer position 115 an elevator 119 is provided mounted on a vertical shaft 120 which, through devices not shown on the drawings, is provided with a vertical alternating movement.

A description will now be given of the operation of the device in question with reference to the graphs in FIG. 5 which represent diagrammatically as a function of the degrees of rotation of a common drive shaft, the pause and movement times of the most significant parts in the device.

In the said graphs, the horizontal lines represent the pause times, the upward sloping lines represent the forward movement times, and the downward sloping lines represent the return movement times in respect of the said significant parts.

At 121 pieces of candy or more generally products substantially parallelepiped in shape, individually preenshrouded in a wrap by means that are not illustrated, are shown.

With the rotatable head 27 halted, the products 121 are fed individually, placed on edge with respect to the axis of the said head 27, into the chamber 46, flush against the vertical wall 39 whose function is to act as buffer means.

Figure 5:
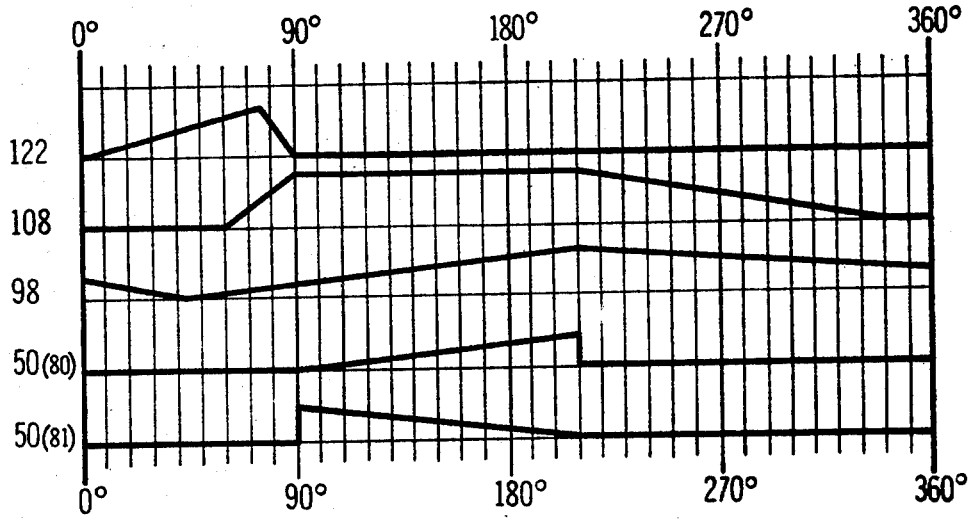
FIG. 5 shows, in the form of graphs traced with respect to one common reference, the pause and movement times of the significant parts of the device in question, in respect of one machine cycle.

During the said infeed operation carried out by a pusher 122 that is provided with a direct reciprocating movement perpendicular to the axis of the head 27, the pusher 98 is kept by its operating mechanism in the limit position outside the said chamber 46, while the lamina member 108, in the upper limit position, delimitates the chamber 46 on the side opposite to the head 27 (see also the graphs in FIG. 5).

Consideration will now be given to the way in which the device in question operates from the time when the Geneva wheel 22 gives, through the shaft 23, the rotatable head 27 a 60° clockwise rotation arounds its own axis.

The compartment 28, which subsequently to the said rotation is placed in the infeed position 34, has the counter-pusher 50 connected thereto in the right hand limit position, looking at FIGS. 1 and 2, and thus in the position in which it is fully inserted in the said compartment 28.

The disk 52 relative to the said counter-pusher 50 is, consequently, in the region of the inlet extremity of the said compartment 28.

The counter-pusher 50 in respect of the compartment 28 immediately upstream of that mentioned above is, as are also all the counter-pushers 50 corresponding to all the remaining compartments, placed in the opposite disengagement or left hand limit position.

The disks 52 with which the said counter-pushers 50 are provided are, therefore, contained inside their respective housings 53 machined in the circular plate 29.

Once the pusher 122 has fed a product 121 inside the chamber 46, the lever 104 operated by the cam 89 gives the lamina 108 a downward movement towards the lower limit position to disengage it from the mouth of the compartment 28 located in the infeed position 34.

As the pusher 122 retracts towards its initial position, the pusher 98, actuated by the cam 88, causes its forward travel towards the inside of the chamber 46 to be commenced, carrying the product 121 inserted in the said chamber in contact with the disk or wall 52 that is located at the mouth of the compartment 28.

At this point, the Geneva wheel 60, through the gears 70 and 71, the shaft 72, the pair of bevel gears 74 and 75, the shaft 77 and the gear 80, gives a direct right to left movement to the counter-pusher 50 corresponding to the compartment 28 located in the infeed position 34 at a speed identical to that at which the pusher 98 advances (see the graphs in FIG. 5).

The product 121 interposed between the two disks 52 and 99, the former corresponding to the considered counter-pusher 50 and the latter to the pusher 98, is then accompanied inside the compartment 28 over a distance whose length is substantially identical to its gage or dimension transversely to the movement direction.

It should be noted that under such conditions, the said disk 52 constitutes the movable bottom wall for the compartment 28 under consideration.

Contemporaneously with the above described operating stages, through the pair of bevel gears 74 and 76, the shaft 78, the gear 81 and the rack 51 that meshes therewith, the counter-pusher 50 in respect of the compartment 28 adjacent to and immediately upstream of the one at a halt in the infeed position 34, moves from left to right over a distance whose length is substantially equal to the gage of the products 121.

With the inversion of movement of the pusher 98 and thus with the parting of the disk 99 from the product 121, the lamina 108 slides upwards and is placed in contact with the product 121 so as to prevent it from capsizing towards the outside of the compartment 28.

The said lamina 108 then contemporaneously performs a guide function at the time of the insertion of the products 121 inside the chamber 46, and a restraining function for the products 121 inserted in the compartment 28.

At this juncture, a fresh product 121 is inserted inside the chamber 46 by the pusher 122.

Identically to what has been seen previously, the pusher 98 engages the second product 121 and, following the descent of the lamina 108, pushes it in contact with the former product and then inside the compartment 28 contemporaneously with the second step towards the left of the counter-pusher 50.

At the same time, the counter-pusher 50 corresponding to the compartment 28 adjacent to and upstream of the preceding compartment, undergoes a further movement towards the inlet extremity of the said compartment 28.

The operations described are performed in succession until the compartment 28 at a halt in the infeed position 34 has been completely filled.

When considering that, in the particular form of embodiment described herein, the kinematic chain that terminates at the shaft 14 and comprises the Geneva wheel 60, the gears 70 and 71, the shaft 72 and the mechanisms contained in the cavity 73, gives two counter pushers 50, in the course of each pause of the rotatable head 27, a series of ten axial sliding movements whose amplitude is identical to the gage of the products 121 and to 1/10 of the axial dimension of the compartments 28, upon completion of a batch 123 of ten products 121, the counter-pusher 50 corresponding to the compartment 28 under consideration can be seen to be in its disengagement position.

Contrarily, the counter-pusher 50 adjacent to and upstream of that mentioned above is in the position of full insertion in its compartment 28.

At this point, actuated by the Geneva wheel 22, the rotatable head 27 undergoes a clockwise rotation through 60°. The compartment 28 in which the batch 123 is contained, as a consequence of this, is transferred to a position midway between the infeed position 34 and the exit position 37, while the former is taken over by the compartment 28 upstream thereof, which pauses there to await the formation of a fresh batch 123.

A further rotation through 60° of the rotatable head 27 causes the transfer of the batch 123 from the said midway position to the exit position 37.

With each movement of the rotatable head 27, the counter-pushers 50 whose racks 51 are free from engagement with the gears 80 and 81, are locked axially through the circular ring guide 82 engaging with the relevant racks 51.

During their transfer between the positions 34 and 37, the batches 123 are kept in a correct position inside their compartments 28 by the two two carinated guides 35 and 36 and by the plate 47. At the said exit position 37, the batch 123 is inserted between the two laminae 113 and 114 by the U shaped device 112 at a halt in the limit position inside the rotatable head 27, and following a clockwise rotation of the said device 112, it is placed above the elevator 119 which is in its lower limit condition.

During the transfer from position 37 to position 115, the batch 123 is kept compact and guided not only by the plate 111 and the laminae 113 and 114 of the U shaped device 112 but also by the two carinated guides 116 and 117 and by the plate 118.

The elevator 119 then attends to infeeding the batch of products 123 to wrapping devices that are not depicted since they do not form the subject of the present invention. After the return of the elevator 119 in its lower limit position, the U shaped device 112 reoccupies its position inside the rotatable head 27 pending a fresh batch 123 being formed.

From the preceding description it can clearly be seen that the products are treated with the utmost delicacy and that, at the same time, they are kept under perfect control right from the moment of their insertion inside the chamber 46.

This, during the formation of the batch, is thanks to the combined action of the pusher 98, the counter pusher 50 and its disk 52, and the lamina 108, which jointly perform the functions of acting as devices for accompanying and restraining the products 121 in their correct position.

It should also be noted that the insertion operation of each counter pusher 50 within the corresponding compartment 28 is achieved in parallel with the operation of forming a batch 123, with the result that the output speed of the device in question is in no way affected.

A further advantageous characteristic of the device according to the present invention with respect to devices of a known type is represented by the reduced radial dimensions of the rotatable head 27, with a consequential reduction of the forces of inertia in play.

The compartments 28, in fact, present themselves arranged, along their longitudinal dimension, parallel to the axis of rotation of the rotatable head. For this reason too, the device in question is advantageous compared with those of the known prior art.

What is claimed is:

1. Device for forming and transferring batches of products in automatic wrapping machines, comprising an intermittently rotatable head rotating about an axis and provided with circumferentially equidistant compartments for holding batches of products, said compartments being arranged longitudinally parallel to said axis and having front and back extermities that are longitudinally spaced, means to rotate said head, a pusher located, with respect to the said rotatable head, in the region of a product infeed position at which the said compartments pause in succession, the said pusher being movable in the direction of the said compartments with a to-and-fro motion longitudinally thereto, through said front extremity, an infeed device for supplying the products individually to the said pusher, located in the region of the said infeed position, at least one movable wall placed inside each of the said compartments in such a way as to receive flush thereagainst the first of the products inserted therein, a corresponding support member secured to each of said movable walls, slidable longitudinally to the compartment concerned in order to guide the said walls from the said front extremity towards the back extremity of the compartment and then back to the front extremity position, and a device for taking possession of a formed batch of products, placed, with respect to the rotatable head, in the region of an exiting position for the formed batches of products, located downstream of the said infeed position in the direction of rotation of the said rotatable head, wherein essential features of the device include a stationary chamber adjacent the infeed position of said rotatable head in which the products supplied by the said infeed device are held immobile, placed along the path followed by the said pusher and in the proximity of the front extremity of the said compartments; a lamina that lies on a plane substantially perpendicular to the axis of the rotatable head between the said stationary chamber and the said front extremity, and is movable alternately over the said plane between a first position in which the front extremity of the compartment in the rotatable head at a halt in the product infeed position is closed and a second position in which the said front extremity is left open; and a pair of drive devices each having a drive shaft and having intermittent motion in directions opposite to each other, that operate in synchronization with the forward movement of the pusher and are so arranged as to drive an intermittent motion in successive steps, during each pause of the said rotatable head, the wall support member placed inside the compartment located in the region of the said infeed position, so as to displace the wall concerned from the front extremity to the back extremity of the said compartment and thereby form a batch of products between said advancing pusher and said wall, and to drive the wall support member placed inside a compartment upstream of the previously mentioned compartment, so as to displace the wall concerned from the back extremity to the front extremity of the said compartment, respectively.

2. Device according to claim 1, wherein the said rotatable head is mounted on a horizontal axis, is supported cantilever fashion and comprises a plate of circular section that constitutes the back extremity of the said compartments, and bars supported in the form of brackets by the said circular plate which define, two by two, the longitudinal and radial walls for each of the said compartments.

3. Device according to claim 2, essential features of which are that it comprises between the said infeed position and the position where the batches of products are taken into the possession of said device, two carinated guides concentric to the said head and delimitating the said compartments internally and externally with respect to the said axis of rotation, and a guide plate perpendicular to the said axis of rotation and closely attached to the free extremity of the said bars.

4. Device according to claim 1, wherein the members for supporting the said movable walls placed inside each compartment are constituted by shafts parallel to the axis of the said rotatable head, integral at one extremity with the said movable walls and supplied at the other extremity with racks that mesh, in subsequent phases, and individually, with a pair of gears fixedly mounted on said shafts of the said pair of drive devices.

5. Device according to claim 4, essential features of which are that the said pair of drive devices provided with an intermittent motion in an opposite movement direction to one another, comprise: a Geneva wheel connected to, and carried in movement by, devices for moving the rotatable head, connected mechanically to a first bevel gear, two mechanisms symmetrical, with respect to a radial plane, with the said head and counter-rotating, each of which constituted by a second bevel gear that meshes with the said first bevel gear and each of said second gears is fixedly mounted to one of said drive shafts, the said gears being so positioned as to mesh one separately from the other, but in synchronism, with the rack belonging to the shaft that supports the movable wall placed inside the compartment at a halt in the said infeed position, and with the rack belonging to the shaft that supports the movable wall placed inside the compartment adjacent to and upstream of the preceding compartment, respectively.

6. Device according to claim 4, essential features of which are that it comprises a fixed guide coaxial to the rotatable head and placed along the path described by the racks of the said shafts, which support the movable walls placed inside the compartments in the rotatable head in such a way as to engage with the said racks, or for the said racks to engage with them, during the rotation of the said rotatable head.

7. Device according to claim 3, essential features of which are that the said device that takes possession of the batches of products comprise a U shaped member constituted by a bottom plate and by two lateral laminae that extend parallel to the axis of the rotatable head, the said U shaped member being supported by a shaft parallel to the axis of the said rotatable head and able to oscillate, in time with the rotation movement of the rotatable head, between a position inside the latter, corresponding to the said exit position, in which the said laminae and the said plates are placed in continuation of the said carinated guides and of the said guide plates, respectively, and what is called the transfer position outside the rotatable head; fixed members being provided between said exit position and the said transfer position for holding and guiding the formed batch of products, comprising two carinated guides that externally and internally delimitate the said U shaped member with respect to the axis of rotation thereof, and a plate perpendicular to the said axis of rotation and opposite the free extremity of the said laminae.

* * * * *